US005309615A

United States Patent [19]

Tachibana et al.

[11] Patent Number: 5,309,615

[45] Date of Patent: May 10, 1994

[54] DROPPER RANDOM-SEPARATING MECHANISM

[75] Inventors: Juro Tachibana, Matsuyama; Yoshihide Nishimura, Ehime, both of Japan

[73] Assignee: Teijin Seiki Co., Ltd., Osaka, Japan

[21] Appl. No.: 958,749

[22] Filed: Oct. 9, 1992

[30] Foreign Application Priority Data

Oct. 24, 1991 [JP] Japan ..... 3-275890

[51] Int. Cl.[5] ..... D03J 1/14

[52] U.S. Cl. ..... 28/207; 28/205

[58] Field of Search ..... 28/200, 201, 203.1, 28/204, 205, 206, 207, 208, 202; 139/351, 354

[56] References Cited

U.S. PATENT DOCUMENTS

| | | | |
|---|---|---|---|
| 3,653,106 | 4/1972 | Fleischer | 28/206 |
| 3,744,109 | 7/1973 | Dohi et al. | 28/206 |
| 4,891,871 | 1/1990 | Tachibana | 28/206 X |

FOREIGN PATENT DOCUMENTS

| | | | |
|---|---|---|---|
| 298696 | 1/1989 | European Pat. Off. | 28/206 |

*Primary Examiner*—Clifford D. Crowder

*Assistant Examiner*—Larry D. Worrell, Jr.

*Attorney, Agent, or Firm*—Lane, Aitken & McCann

[57] ABSTRACT

A dropper random-separating mechanism comprising a plurality of dropper rows arranged in parallel, a plurality of pairs of separating pawls corresponding in number to the plurality of dropper rows, each pair of separating pawls being adapted for separating a foremost dropper of the corresponding dropper row so that a predetermined dropper separation space is formed between the foremost dropper and the following droppers of the corresponding dropper row, a plurality of cams provided on a common rotational shaft, each cam being adapted for driving the corresponding separating pawl, a plurality of power transmission units provided between the cams and the separating pawls for forming power transmission paths between the cams and the separating pawls, a drive unit for driving the common rotational shaft so that one separating pawl of the plurality of pairs of separating pawls is actuated by the corresponding cam, and a regulating unit for connecting and disconnecting the power transmission paths. The actuation of the one separating pawl is regulated by disconnecting the corresponding power transmission path when the common rotational shaft is rotated.

2 Claims, 7 Drawing Sheets

DROPPER RANDOM-SEPARATING MECHANISM

FIELD OF THE INVENTION

The present invention relates to a dropper separating mechanism that is provided in a machine for automatically threading a dropper used for detecting thread breakage, and more particularly to such a mechanism which makes a random separating operation possible.

DESCRIPTION OF THE PRIOR ART

Before weaving can commence, a threading operation in which a heddle or dropper is threaded with a warp thread is required as a preparatory operation. Since this threading operation is a complicated one in which a great number of warp threads (e.g., several thousand threads) have to be drawn one by one through the heddle or dropper, a variety of automatic threading machines have been developed. A threading machine in which threading is mechanically performed by passing a hooked needle through a threading bore of the dropper is known as a conventional threading machine. However, the mechanical threading machine has its disadvantages in that threading cannot be performed at high speeds and a sufficient percentage of success of threading cannot be achieved.

A threading operation using air flow has lately been put to practical use. This threading machine requires a dropper separating mechanism in order to separate a dropper to a predetermined threading position quickly and certainly.

A dropper separating mechanism of the above kind is shown in FIGS. 7(*a*) and 7(*b*) by way of example. In this separating mechanism, droppers arranged in a row are pushed forward and slightly bent by pushing means and the speed of separating operation is increased by releasing a foremost dropper of the bent droppers. FIGS. 7(*a*) and 7(*b*) show the front side of one row among a plurality of dropper rows arranged in parallel. A plurality of droppers 1 each having an asymmetrical mountain portion 1*a* are alternatively superimposed backward and forward so that the asymmetrical mountain portions 1 of two adjacent droppers do not overlap each other, and supported on a dropper bar 2. The droppers supported on the dropper bar 2 are guided by guide members 4A and 4B. Then, a rearmost dropper of the dropper row is pushed forward by pushing means (not shown) and a foremost dropper of the dropper row is limited to move forward by an upper separating pawl 3 and a lower pin (not shown). With this state, the dropper row is bent proportionally to the pressure of the pushing means. Therefore, if the separating pawl 3 is rotated in the right or left direction of FIG. 7, then it is disengaged from the mountain portion 1*a* of the foremost dropper 1 and the foremost dropper 1 is released from its bent state and returns back to its straight state. At the same time, a predetermined dropper separation space is formed between the foremost dropper in the straight state and the dropper row in the bent state. In such a dropper separating mechanism, the order of separations of the dropper rows arranged in parallel is constant and cannot be changed. It is therefore difficult to thread the dropper rows in optimum order. For example, droppers different in external appearance cannot be used as identification marks corresponding to types of threads.

It is, accordingly, an important object of the present invention to provide a random separating mechanism which is capable of easily changing the order of separations of dropper rows arranged in parallel.

SUMMARY OF THE INVENTION

The foregoing object is accomplished in accordance with the present invention by providing a dropper random-separating mechanism comprising a plurality of dropper rows arranged in parallel, each dropper row having a plurality of droppers superimposed in a predetermined direction, and a plurality of pairs of separating pawls corresponding in number to the plurality of dropper rows. Each pair of separating pawls is adapted for separating a foremost dropper of the corresponding dropper row so that a predetermined dropper separation space is formed between the foremost dropper and the following droppers of the corresponding dropper row. A plurality of cams are provided on a common rotational shaft, each cam being adapted for driving the corresponding separating pawl. A plurality of power transmission means are also provided between the cams and the separating pawls for forming power transmission paths between the cams and the separating pawls. The dropper random-separating mechanism further comprises drive means for driving the common rotational shaft so that one separating pawl of the plurality of pairs of separating pawls is actuated by the corresponding cam, and regulating means for connecting and disconnecting the power transmission paths. The actuation of the one separating pawl is regulated by disconnecting the corresponding power transmission path when the common rotational shaft is rotated.

The plurality of cams may be integrally formed in a drum.

In the present invention, during the time that the rotational shaft is rotated by the drive means, the power transmission path from the cam to the separating pawl is disconnected by the regulating means. Then, if the rotation of the rotational shaft is stopped, the power transmission path is connected and one separating pawl is operated by the corresponding cam. Accordingly, by controlling the rotational position of the rotational shaft, an arbitrary separating pawl can be operated and also a drive system for the cams can be made structurally simple. In addition, since the plurality of cams can be integrally formed in a drum, component working and assembly operation can made simple and also production cost can be reduced.

BRIEF DESCRIPTION OF THE DRAWINGS

The above and other objects and advantages will become apparent from the following detailed description when read in conjunction with the accompanying drawings wherein:

FIG. 5(*b*) is an enlarged front view showing the separating pawls and the droppers;

DESCRIPTION OF THE PREFERRED EMBODIMENTS

Referring to FIGS. 1–6, there is shown a preferred embodiment of a dropper random-separating mechanism in accordance with the present invention.

Figure 5A:
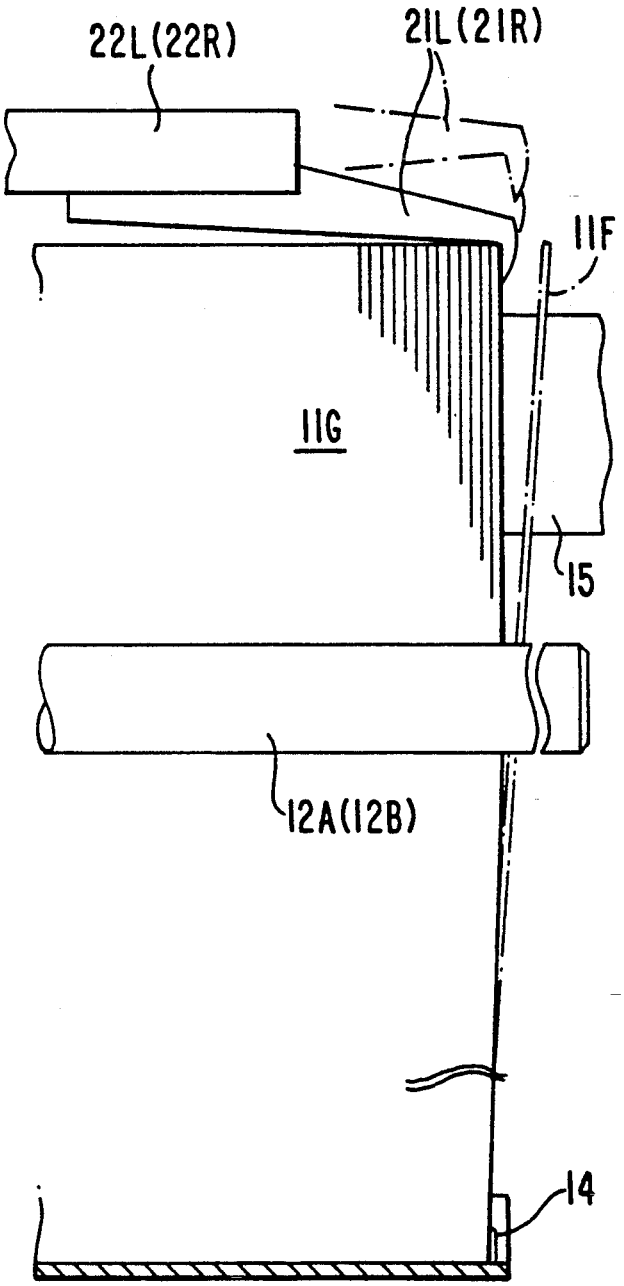
FIG. 5(*a*) is an enlarged side view showing the separating pawls and droppers to be separated.
Figure 5B:
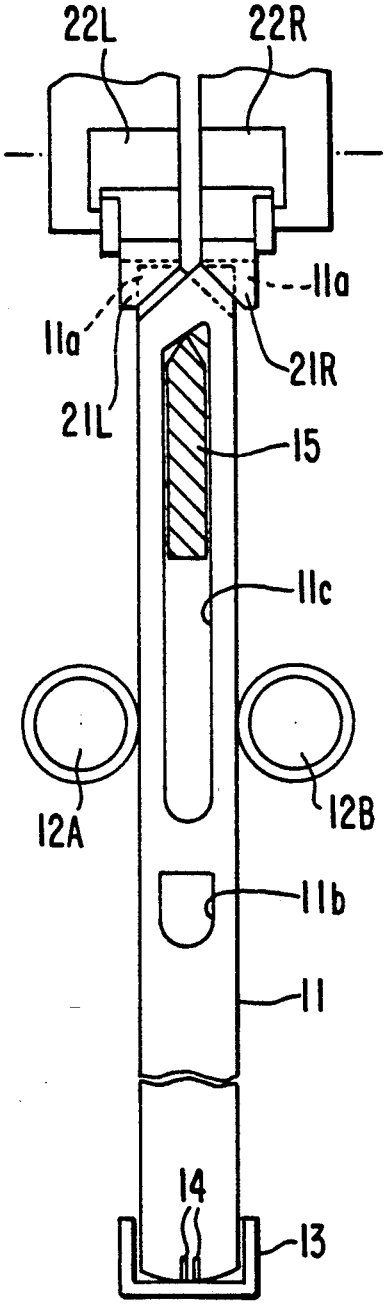
Figure 6:
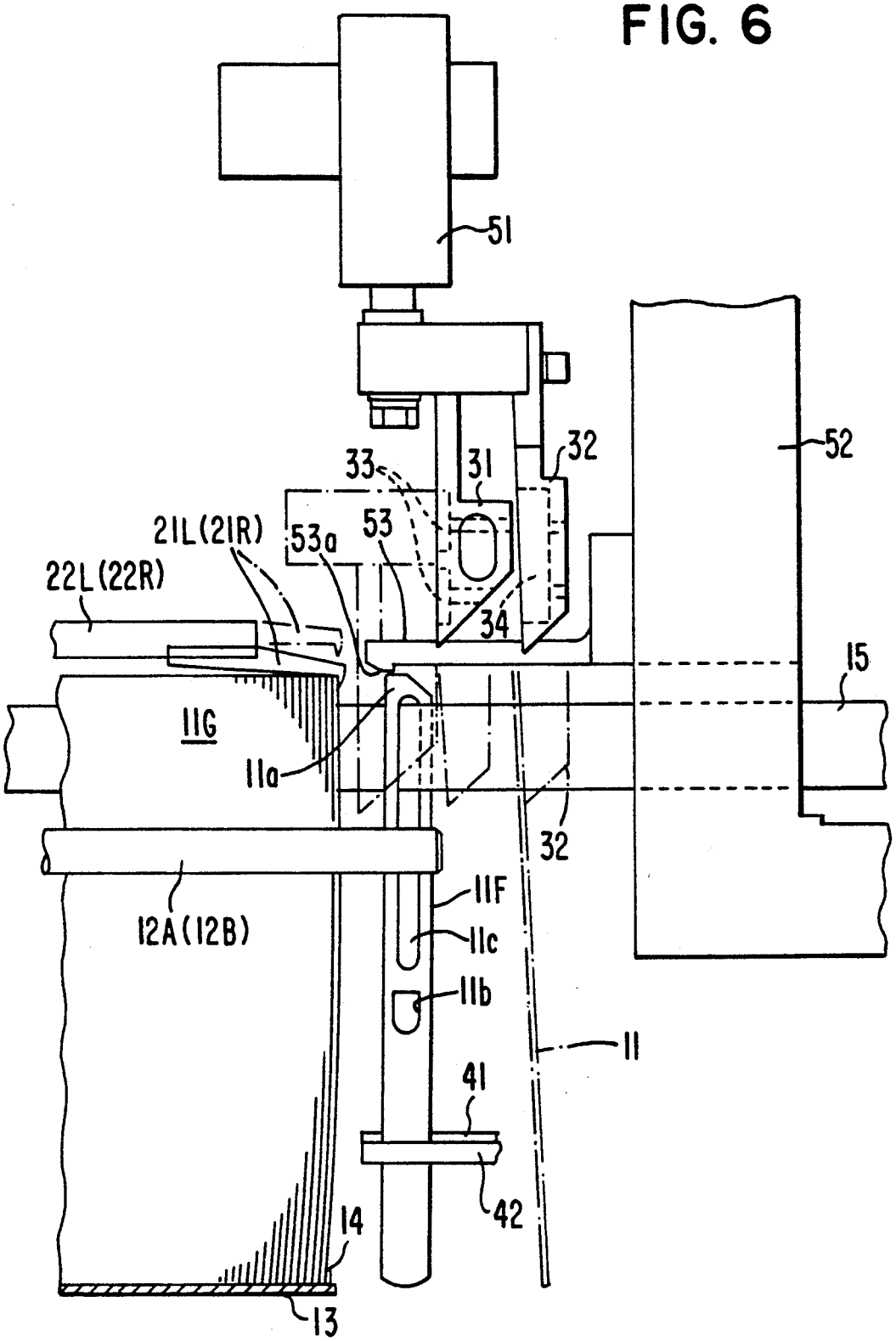
FIG. 6 is a diagram used to explain the separating operation of the droppers.
Figure 7A:
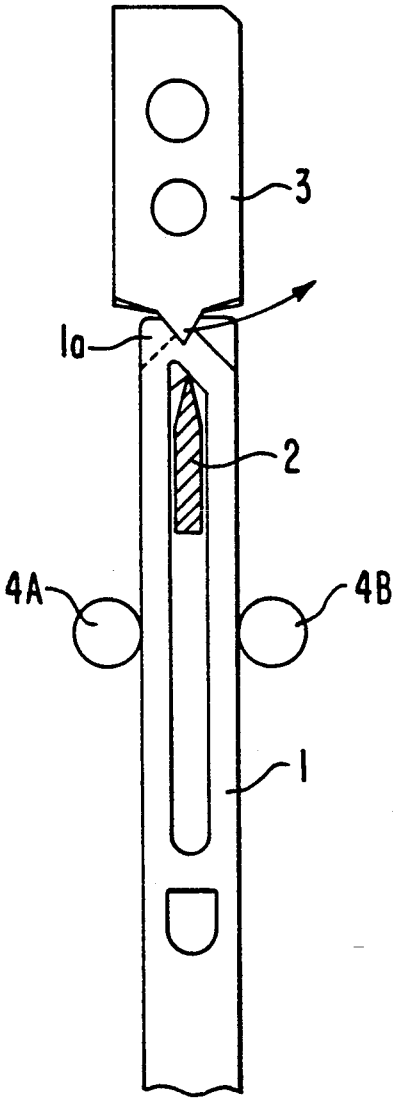
FIG. 7(a) PRIOR ART
FIG. 7(*a* and *b*) is a front view showing the separating pawl of a conventional dropper separating mechanism.
Figure 7B:
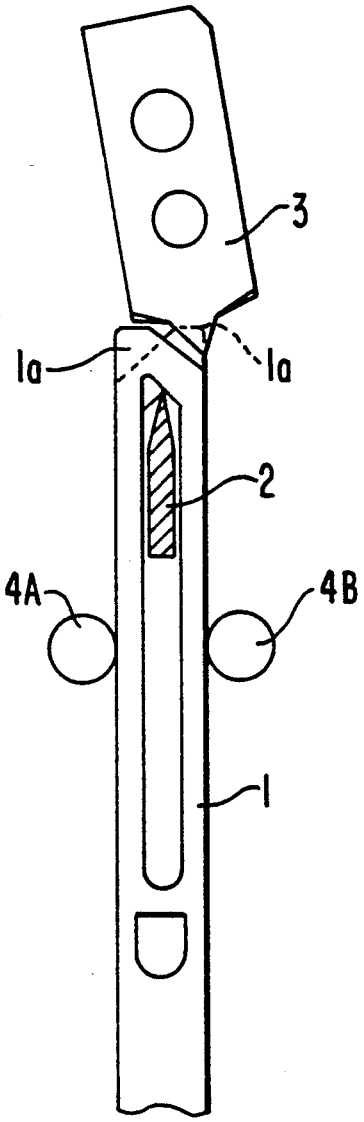
FIG. 7(b) PRIOR ART

In FIGS. 5 and 6, reference numeral 11 denotes a plurality of droppers which are disposed in a predetermined position of a threading machine (the overall structure is not shown). As shown in FIG. 5(*b*), each dropper 11 is formed at its upper end with an asymmetrical mountain portion 11*a* and at its longitudinal central portion with a threading bore 11*b*. Between the asymmetrical mountain portion 11*a* and the threading bore 11*b*, the dropper 11 is further formed with an elongated bore 11*c*. A plurality of the droppers 11 are alternatively superimposed backward and forward so that the asymmetrical mountain portions 11*a* of two adjacent droppers 11 do not overlap each other, and are aligned and supported on a dropper bar 15 through the elongated bores 11*c*. The aligned droppers 11 are guided by guide pins 12A and 12B and a guide rail 13 and constitute a dropper group 11G. In this embodiment, there are provided six rows of dropper groups. A rearmost dropper of each dropper group 11G is pushed with a predetermined pressure from the left direction to the right direction of FIG. 5(*b*) by a pusher or pushing means (not shown). A forward movement of the foremost dropper 11F is limited by a separating pawl 21L or 21R and two stop pins 14 (fixed pawls) mounted in the fore end of the guide rail 13. The two stop pins 14 are fixed pawls which are capable of limiting the forward movement of the lower end of the foremost dropper 11F.

As shown in FIGS. 1–4, the separating pawls 21L and 21R are provided in each row of droppers and are a pair of movable pawls that are movable in the dropper longitudinal direction at the front side of the dropper 11. The separating pawls 21L and 21R, as shown in FIG. 5(*a*), are also movable between a dropper stop position (position indicated by the solid line) in which the forward movement of the mountain portion 11*a* of the foremost dropper 11F is limited and a dropper separation position (position indicated by the dotted line) in which the mountain portion 11*a* of the foremost dropper 11F is separated from the remaining droppers of the dropper group 11G. As shown in FIG. 5(*b*), when the separating pawl 21L or 21R is moved into the dropper separation position, the foremost dropper 11F will be changed from its bent state to its straight state, so that a predetermined dropper separation space will be formed between the separated dropper 11F and the bent dropper group 11G.

The separating pawls 21L and 21R are carried by oscillating arms 22L and 22R, respectively, which are oscillated about an oscillation-center shaft 22*c* located above the dropper group 11G. The oscillating arms 22L and 22R are supported by a fixed frame 23 so that the oscillating arms 22L and 22R can be freely oscillated upward and downward. The fixed frame 23 is fixedly mounted on a frame structure of the above-mentioned threading machine. The oscillating arms 22L and 22R are also connected at a position above the oscillation-center shaft 22*c* to followers 25L and 25R through link members 24L and 24R. If the follower 25R engages with a pawl selecting drum 26, the separating pawl 21R will be oscillated upward and downward about the oscillation-center shaft 22*c*. Likewise, if the follower 25L engages with the pawl selecting drum 26, the separating pawl 21L will be oscillated upward and downward about the oscillation-center shaft 22*c*. The oscillating arms 22L, 22R, link members 24L, 24R, and the followers 25L, 25R are power transmission members which form a power transmission path from the pawl selecting drum 26 to the separating pawls 21L and 21R.

Figure 1:
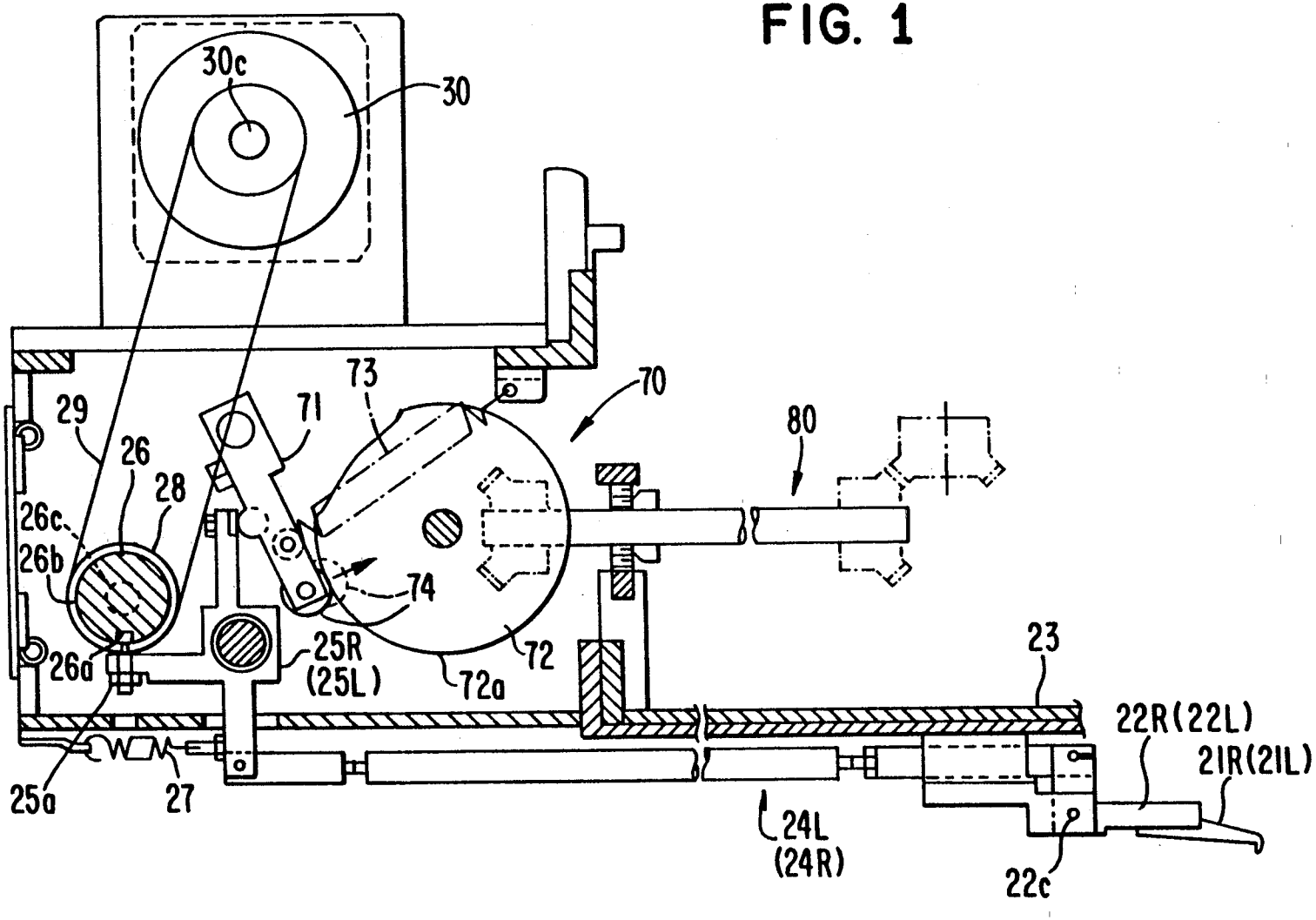
FIG. 1 is a side elevational view showing an embodiment of a dropper random-separating mechanism according to the present invention.
Figure 2:
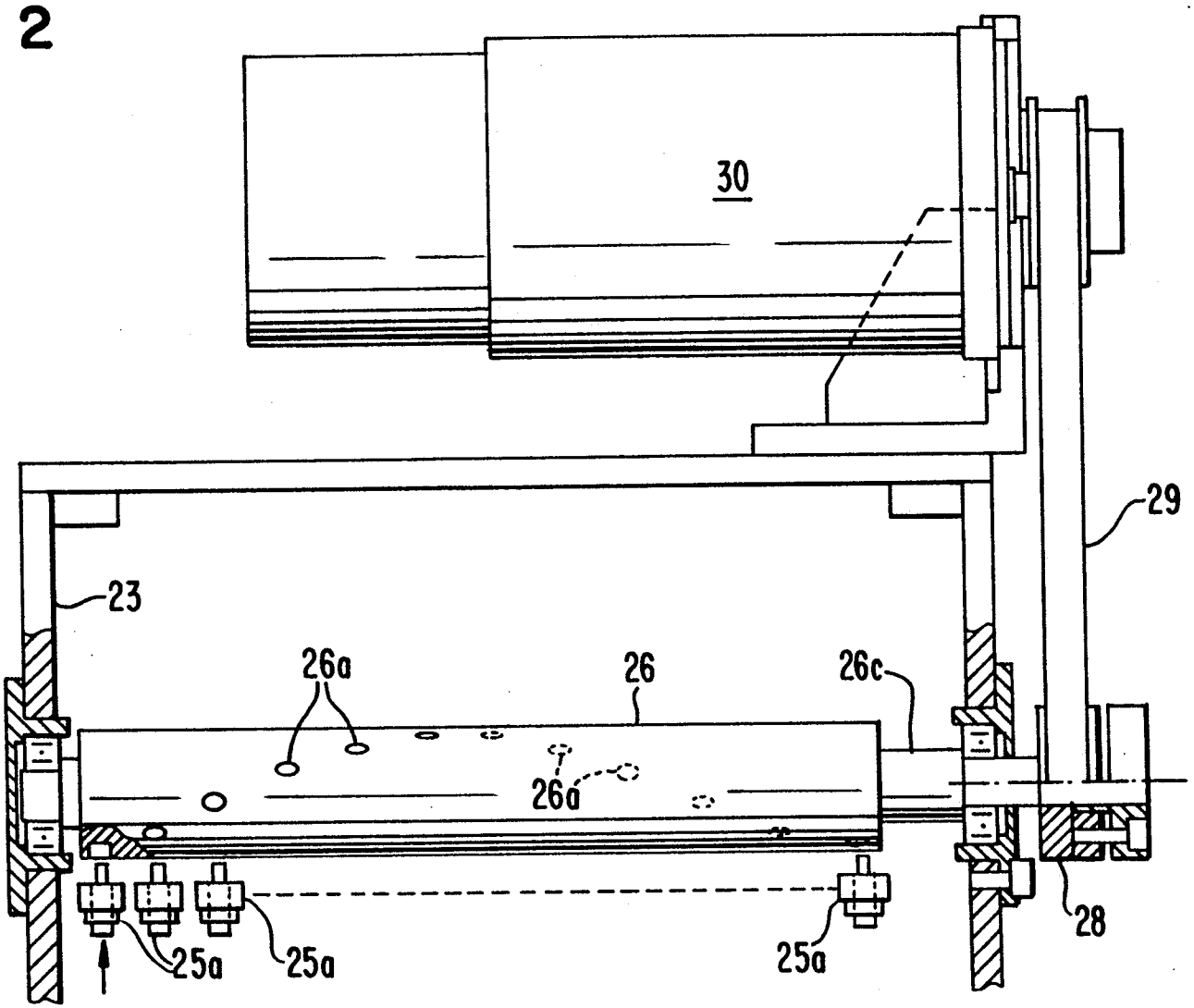
FIG. 2 is an enlarged top view of the pawl selecting drum of FIG. 1.
Figure 3:
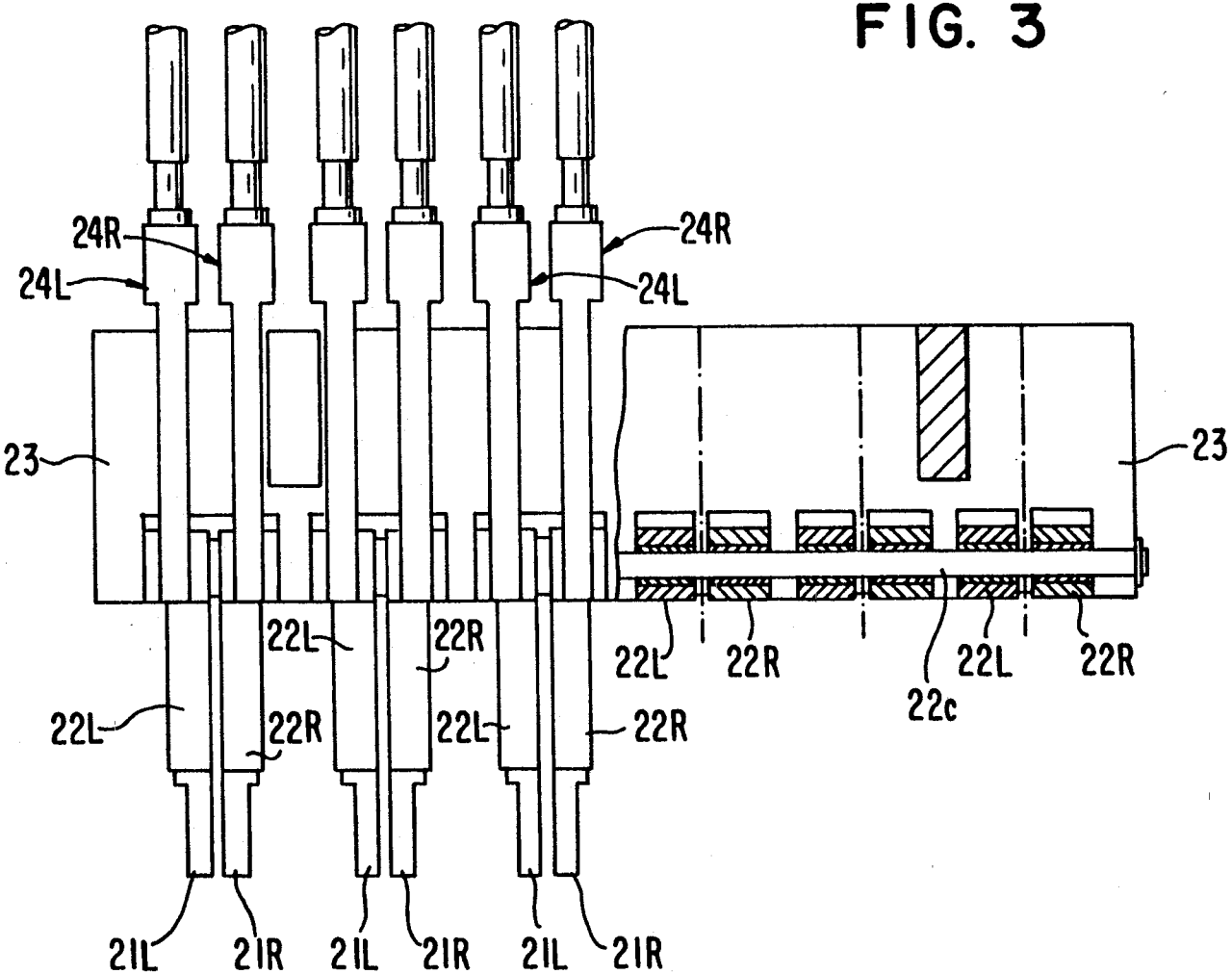
FIG. 3 is a top view of the separating pawls of FIG. 1 which are driven by the pawl selecting drum.
Figure 4:
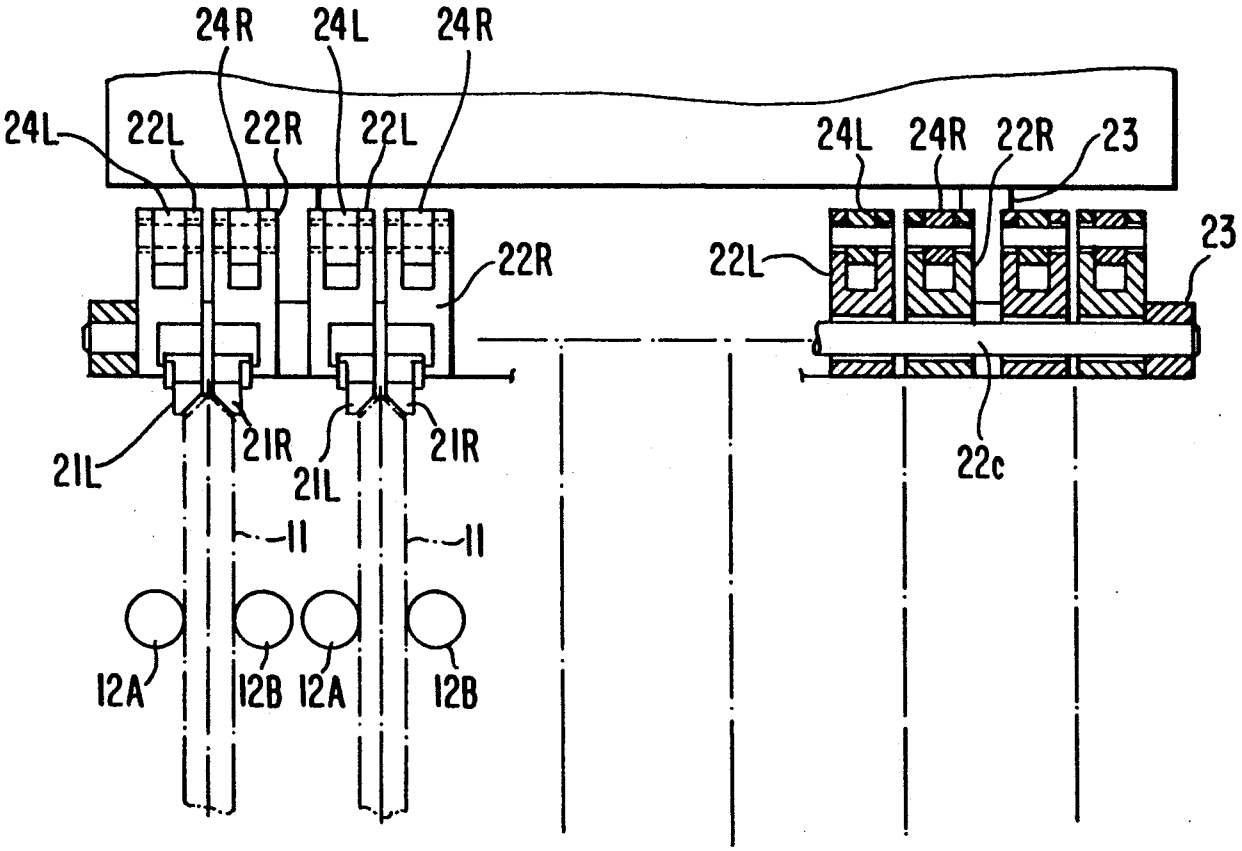
FIG. 4 is a front view showing the separating pawls.

The pawl selecting drum 26, as shown in FIG. 2, is formed with a plurality of concavities 26*a* so that the separating pawls 21L and 21R are engaged with and disengaged from the dropper 11. These concavities 26*a* are arranged with a predetermined space (e.g., equal pitch) in the circumferential direction of the drum 26 and equidistantly in the axial direction of the drum 26. The pawl selecting drum 26 can also be formed with a plurality of convexities instead of the concavities 26*a*. The pawl selecting drum 26 is integrally formed with a plurality of cams each comprising the concavity 26*a* and the outer surface 26*b* (FIG. 1) of the drum 26, and is supported on a rotational shaft 26*c*. The followers 25L and 25R are always urged in the clockwise direction of FIG. 1 by a spring 27 so that the passive arms 25*a* of the followers can be pushed against the outer surface 26*b* of the drum 26. If one of the passive arms 25*a* is inserted by the spring 27 into the concavity 26*a* located at the lowest position of the drum 26, the follower 25L or 25R having that passive arm 25*a* will cause the oscillating arm 22L or 22R to oscillate upward through the link member 24L or 24R. This upward movement of the oscillating arm causes the selecting pawl 21L or 21R to move into the dropper separation position.

In the embodiment of the present invention, the rotations of the followers 25L and 25R are suitably regulated by regulating means 70 so that, when the following threading operation is performed one time, the separating operation of the separating pawls 21L and 21R is performed only for a predetermined period of time. This regulating means 70 comprises a stopper 71, a stopper controlling cam 72 having an outer surface 72*a* and a concavity portion 72*b* for controlling the stopper 71, and a tension spring 73. The stopper 71 has a roller 74 at its one end and engages at its intermediate portion with arm portions of the followers 25L and 25R. In the state that the roller 74 of the stopper 71 is brought into engagement with the outer surface 72*a* of the stopper controlling cam 72, the clockwise rotations of the followers 25L and 25R are limited and, at that time, the passive arms 25*a* of the followers 25L and 25R are not inserted into the concavities 26*a* of the pawl selecting drum 26. Therefore, the rotation of the pawl selecting drum 26 for a dividing or indexing operation is performed in the state that the roller 74 of the stopper 71 is brought into engagement with the outer surface 72*a* of the stopper controlling cam 72 and that the stopper 71 is in the oscillation position shown in FIG. 1. Reference numeral 80 denotes a power transmission mechanism for driving the stopper controlling cam 72.

The pawl selecting drum 26 is connected to a servomotor 30 (rotation-drive means) through a pulley 28 mounted on one end of the rotational shaft 26*c* of the drum 26 and through a belt 29. The dividing or indexing operation of the pawl selecting drum 26 is performed every a predetermined angle unit by the servomotor 30, so that the separating pawl 21L or 21R is moved into the dropper separation position. On the basis of location detection information from an encoder (not shown) and selection command information about a row of droppers to be threaded, the servomotor 30 rotates the pawl selecting drum 26 so that the separating pawl 21L or 21R of the dropper row corresponding to the selection command information is moved into the dropper separation position. That is, the dividing of the pawl selecting drum 26 is performed by rotating the rotational shaft 30*c* of the servomotor 30 through an arbitrary rotational angle, which angle is units of a predetermined pitch angle (e.g., 30°) corresponding to the number of the concavities 26*a*, in such a manner that the concavity 26*a* corresponding to the separating pawl 21L or 21R of the dropper row to be separated is moved into the lowest position of the drum 26. Then, the follower 25L or 25R having the passive arm 25*a* which is opposed to the concavity 26*a* located in the lowest position of the pawl selecting drum 26 is oscillated in the clockwise direction of FIG. 1 by the spring 27, and the separating pawl 21L or 21R requested is moved into the dropper separation position and disengaged from the dropper 11.

In FIG. 6, reference numeral 31 denotes a separating arm with magnets 33 and 33. The dropper 11F separated from the dropper group 11G is pulled forward by the magnets 33 of the separating arm 31, and the dropper separation space between the separated dropper 11F and the dropper group 11G is further increased. A first positioning member 41 is then inserted into the increased dropper separation space. If the first positioning member 41 and a second positioning member 42 cooperating with the first positioning member 41 are driven by a drive mechanism (not shown) and come close to each other, the upper half portion of the dropper 11F will be horizontally rotated to the position shown in FIG. 6 and, at that time, the threading bore 11*b* of the dropper 11F is held in a predetermined threading position. A removing arm 32 with a magnet 34 is provided in front of the separating arm 31, and the arms 31 and 32 are supported on a movable frame 51 and movable upward and downward and also backward and forward. The threaded dropper 11F is attracted by the magnet 34 of the removing arm 32 and moved forward by the removing arm 32. Reference numeral 52 denotes a fixed frame of the threading machine supporting the dropper bar 15. The fixed frame 52 has attached thereto a return-prevention member 53 which has an engagement portion 53*a* engageable with the upper end of the separated dropper 11F. The separated dropper 11F is prevented from returning back to the dropper group 11G by the engagement portion 53*a* of the return-prevention member 53.

The operation of the dropper separating mechanism as constructed above will hereinafter be described in detail.

Prior to the operation of the threading machine, a plurality of the droppers 11 are alternatively superimposed backward and forward so that the symmetrical mountain portions 11*a* of two adjacent droppers 11 do not overlap each other, and are aligned. The aligned droppers 11 are guided by the guide pins 12A, 12B and the guide rail 13 and supported on the dropper bar 15 through the elongated bores 11*c* of the droppers 11. Then, the rearmost dropper of this dropper group 11G are pushed forward by the pushing means, and the forward movement of the foremost dropper 11F is limited at the upper and lower ends thereof by one of the separating pawls 21L and 21R and by the stop pins 14 mounted in the guide rail 13. As a result, the aligned droppers 11G are bent proportionally to the pressure of the pushing means. A plurality of droppers of different kinds (e.g., different colors) are also aligned in the same manner as described above.

If, in the alignment state described above, the operation of the threading machine is started, then the separating operation, positioning operation, threading operation and removing operation of the dropper 11 are performed in sequence, and the dropper group 11G is threaded one by one. When these sequential operations occur, the stopper controlling cam 72 is rotated and the stopper 71 engaging with the cam 72 is oscillated in the counterclockwise direction of FIG. 1 in the separating operation. On the other hand, prior to the oscillation of the stopper 71, the servomotor 30 is actuated in accordance with an external control signal and the pawl selecting drum 26 is rotated through a predetermined angle unit so that the concavity 26*a* corresponding to the dropper row to be separated is opposed to the passive arm 25*a* of the follower 25L or 25R. This is the dividing operation of the pawl selecting drum 26. Therefore, when the stopper 71 is oscillated, the passive arm 25*a* of the follower 25L or 25R of any one pair of a plurality of pairs of the followers 25L and 25R is inserted into any one of a plurality of concavities 26*a*, and the remaining passive arms 25*a* are brought into engagement with the outer surface of the pawl selecting drum 26. Then, the follower 25L or 25R having the passive arm 25*a* inserted into the concavity 26*a* of the pawl selecting drum 26 is slightly rotated in the clockwise direction of FIG. 1. This rotation causes one of the separating pawl 21L and 21R to oscillate upward (into the above-mentioned dropper separation position).

When the separating pawl 21L or 21R oscillates upward and is disengaged from the mountain portion 11*a* of the foremost dropper 11F, this dropper 11F is released from its bent state and returns back to its straight state. At that time, there is formed a predetermined dropper separation space between the separated dropper 11F and the upper half portion of the following dropper group 11G. Note that, in the separating operation, the separating pawl 21L or 21R is oscillated in the longitudinal direction of the dropper 11 and also oscillated upward and downward about the oscillation-center shaft 22*c*. In addition, when one separating pawl 21L or 21R is oscillated into the dropper separation position, the following dropper group 11G is limited to move forward by the other separating pawl 21L or 21R.

The dropper 11 separated from the following dropper group 11G is attracted by the magnets 33 of the separating arm 31 that has been stopped forward of the dropper 11, and the dropper separation space between the separated dropper 11 and the following dropper group 11G is further increased by forward movement of the separating arm 31. The positioning members 41 and 42 are then inserted into this increased dropper separation space, and moved toward each other, so that the dropper 11F is held in the position shown in FIG. 6. At this time, the dropper 11 is attracted at its upper side end portion by the magnets 33 and, with this condition, is horizontally rotated about this side end portion.

If the positioning of the separated dropper 11F is completed, the threading bore 11*b* of the dropper 11F is positioned so that the dropper can be threaded by threading means (not shown). For example, a threading nozzle using air flow can be used as threading means. If the dropper 11F is threaded, then the separating arm 31 and the removing arm 32 are moved forward and upward. When the separating arm 31 and the removing arm 32 are moved by a predetermined amount and lowered again, they return back to their original stop positions and a single dropper separating operation is complete.

Thus, in the embodiment of the present invention, the pawl selecting drum 26 is rotated so that the concavity 26*a* corresponding to the separating pawl 21L or 21R which is intended to perform the separating operation is moved into a predetermined position. In addition, during the rotation of the drum 26, the power transmission from the pawl selecting drum 26 to the separating pawls 21L and 21R is interrupted by the regulating means 70, and the separating pawl 21L or 21R that should not perform the separating operation is held in the dropper stop position. Accordingly, only a separating pawl (21L or 21R) that is selected from among a plurality of separating pawls can be driven by controlling the actuation of the servomotor 30, and the separating operation of an arbitrary dropper row among a plurality of rows, i.e., random-separating operation can be performed. As a result, the separations of a plurality of dropper rows arranged in parallel can be randomly performed in optimum order, and the order of the separations can be easily changed. Furthermore, droppers different in external appearance, for example, can be used as identification marks corresponding to types of threads. In addition, since in the dropper separating mechanism of the present invention the cam having the concavities 26*a* is integrally formed with the pawl selecting drum 26, a plurality of pairs of the separating pawls 21L and 21R can be randomly driven by a single servomotor 30 and the separating mechanism can be made structurally simple. Although in FIG. 2 the concavities 26*a* of the pawl selecting drum 26 are equidistantly arranged from one end of the drum to the other end, they can be formed with more effective patterns. For example, the concavities 26 corresponding to the separating pawls 21L can be formed with a predetermined angle space, and the concavities 26 corresponding to the separating pawls 21R can be formed with the same phase as the predetermined angle space.

While the subjection invention has been described with relation to the preferred embodiment, various modifications and adaptations thereof will now be apparent to those skilled in the art. All such modifications and adaptations as fall within the scope of the appended claims are intended to be covered thereby.

What we claim is:

1. A dropper random-separating mechanism comprising:

a plurality of dropper rows arranged in parallel, each dropper row having a plurality of droppers arranged sequentially;

a plurality of pairs of separating pawls equal in number to said plurality of dropper rows, each pair of separating pawls being positioned at a respective dropper row for separating a foremost dropper of said respective dropper row, and each of said separating pawls being movable between a first position in which said foremost dropper is held and a second position in which said foremost dropper is separated from following droppers of said respective dropper row by a predetermined dropper separation space;

urging means for urging each of said separating pawls into said second position;

a cam member formed with a plurality of cam portions and mounted on a common rotational shaft, each cam portion having a first portion by which a corresponding separating pawl is held in said first position and a second portion, said corresponding separating pawl being allowed to be urged into said second position by said second portion;

a plurality of power transmission means provided between said cam member and said separating pawls for forming power transmission paths between said cam member and said separating pawls;

drive means for driving said common rotational shaft so that one separating pawl of said plurality of pairs of separating pawls is held in said first position by the first portion of said cam portion corresponding to said one separating pawl and is allowed to be urged into said second position by the second portion of said cam portion corresponding to said one separating pawl; and regulating means for connecting and disconnecting said power transmission paths, the movement of said one separating pawl into said second position being regulated by disconnecting the corresponding power transmission path when said common rotational shaft is rotated.

2. A dropper random-separating mechanism as set forth in claim 1, wherein the first portions of said plurality of cam portions are constituted by an outer surface of said cam member, and the second portions of said plurality of cam portions are constituted by recesses formed in said outer surface of said cam member, respectively.

* * * * *